US005608506A

United States Patent [19]

Omoto

[11] Patent Number: 5,608,506

[45] Date of Patent: Mar. 4, 1997

[54] IMAGE FORMING APPARATUS EQUIPPED WITH A DEVICE TO MEASURE A RESISTANCE OF A TRANSFER SHEET

[75] Inventor: Tetsuko Omoto, Hachioji, Japan

[73] Assignee: Konica Corporation, Japan

[21] Appl. No.: 354,507

[22] Filed: Dec. 12, 1994

[30] Foreign Application Priority Data

Dec. 20, 1993 [JP] Japan ..... 5-320178

[51] Int. Cl.[6] ..... G03G 15/14; G03G 21/00

[52] U.S. Cl. ..... 399/315; 399/45

[58] Field of Search ..... 355/271, 273, 355/274, 309, 311, 315

[56] References Cited

U.S. PATENT DOCUMENTS

| | | | |
|---|---|---|---|
| 4,134,147 | 1/1979 | Watanabe | 361/235 |
| 4,401,383 | 8/1983 | Suzuki et al. | 355/273 X |
| 5,182,603 | 1/1993 | Yamada | 355/273 |
| 5,231,452 | 7/1993 | Murayama et al. | 355/271 X |
| 5,287,144 | 2/1994 | Takeda | 355/274 X |

FOREIGN PATENT DOCUMENTS 57-64270 4/1982 Japan .

OTHER PUBLICATIONS

Patent Abstracts of Japan, vol. 5 No. 134 (P–077); Aug. 26, 1981 JPA–56–69652; Jun. 11, 1981 (Hiroyuki).

Patent Abstracts of Japan, vol. 7 No. 060 (P–182); Mar. 12, 1983 JPA–57–205,761; Dec. 16, 1982 (Furuichi).

Patent Abstracts of Japan, vol. 7 No. 067 (P–184); Mar. 19, 1983 JPA–57–211,168; Dec. 24, 1982 (Sasaki).

Patent Abstracts of Japan, vol. 7 No. 101 (P–194); Apr. 28, 1983 JPA–58–25,677; Feb. 15, 1983 (Matsushita).

Patent Abstracts of Japan, vol. 17 No. 239 (P–1534); May 13, 1993 JPA–4–362,676; Dec. 15, 1992 (Hiroshi).

*Primary Examiner*—Fred L. Braun

*Attorney, Agent, or Firm*—Jordan B. Bierman; Bierman and Muserlian

[57] ABSTRACT

An image forming apparatus equipped with a registering device to make copy paper temporarily halt before the copy paper is conveyed to an image forming section whereby the image formation of the copy sheet is in synchronization with the working of the image forming section and while the copy paper is halted, an electric resistance of the recording member is measured and an image forming condition is determined in accordance with the measurement result.

9 Claims, 2 Drawing Sheets

IMAGE FORMING APPARATUS EQUIPPED WITH A DEVICE TO MEASURE A RESISTANCE OF A TRANSFER SHEET

BACKGROUND OF THE INVENTION

The present invention relates to an image forming apparatus in which a toner image formed on the surface of a rotating image forming body is transferred onto a transfer sheet sent by a register roller at a transfer position opposed to a transfer charger.

In the above-described image forming apparatus, transfer conditions such as discharging voltage of the transfer charger at which the maximum transfer efficiency can be obtained, etc., change when the resistance of the transfer sheet changes. Accordingly, when transfer conditions are constant, there is a problem in which the transfer efficiency is lowered due to the change of resistance of the transfer sheet. In order to solve the problem, the following image forming apparatus has been disclosed in Japanese Patent Publication Open to Public Inspection No. 34834/1979. A transfer sheet conveyance means, such as a register roller, by which the transfer sheet is sent to a transfer position, is used for an electrode from which current flows in the direction of the thickness of the transfer sheet or in the direction of conveyance of the transfer sheet so that the resistance of the transfer sheet can be measured. According to the measured information, charging conditions of the transfer charger or a separation charger are determined so that high transfer efficiency or reliability of sheet separation can be stably obtained, independent of change of moisture content. Further, the following image forming apparatus has been disclosed in Japanese Patent Publication Open to Public Inspection 14271/1981. A pick-up roller for sending the transfer sheet stacked in a sheet feed cassette is used for an electrode from which current flows in the direction of conveyance of the transfer sheet and the direction of the length, perpendicular to the direction of the conveyance of the transfer sheet so that the resistance of the transfer sheet can be measured. According to the measured information, charging conditions of the transfer charger or the separation charger are determined.

In the resistance measuring method disclosed in Japanese Patent Publication Open to Public Inspection No. 34834/1979, since the transfer sheet is not pinched when electrode rollers stop, the resistance of the transfer sheet is measured during the conveyance of the transfer sheet. Accordingly, a varied, unstable measured value is obtained as shown by amplifier outputs V2 and V4 in FIG. 5 (which will be described later). Further, in this method, when it is required to correct the measured value using a reference value which is obtained under the same conditions as the resistance measurement of the transfer sheet so that the influence due to deterioration with time of the electrode rollers or the amplifier, etc., is excluded, it can not be corrected because the reference value is obtained after the the measured value has been obtained. Accordingly, satisfactory measurement accuracy can not be obtained.

Further, in the resistance measuring method disclosed in Japanese Patent Publication Open to Public Inspection 14271/1981, considerably local resistance between two points on the surface of the stacked transfer sheet is measured. Accordingly, when the contact position of the electrode rollers with the transfer sheet changes due to the conveyance of the transfer sheet, etc., then, an easily variable, unstable measured value is obtained. Therefore, in this method, the measured value can not be corrected by the reference value, and adequate measuring accuracy can not be obtained. Further, in this method, when voltage of about 500V is not impressed upon the pick-up roller, the output of the measurement becomes too small, so that this method is dangerous. Further, in this method, there is a problem in which a measuring apparatus for resistance of the transfer sheet is necessary for each sheet feeding means.

That is, in the image forming apparatus disclosed in both patent publications, even when charging conditions of the transfer charger or the separation charger are determined according to the resistance of the transfer sheet, sufficient transfer efficiency or separation efficiency can not be obtained.

SUMMARY OF THE INVENTION

The present invention is offered to solve the above-described problems. An object of the present invention is to provide an image forming apparatus which can measure the resistance of the transfer sheet stably and highly accurately. The object of the present invention is also to provide the image forming apparatus in which high transfer efficiency can be stably obtained when charging conditions of the transfer charger, etc., are determined according to the measured information, and only one resistance measuring means is necessary even when a plurality of sheet feeding means of the transfer sheet are adopted in the apparatus.

In order to accomplish the above-described object, in an image forming apparatus of the present invention including processing means for forming an image on a transfer sheet, a toner image formed on the surface of a rotating image forming body is transferred onto a transfer sheet sent by a register roller at a transfer position opposed to a transfer charger. Further, the image forming apparatus of the present invention is characterized in that the image forming apparatus comprises a measuring apparatus for measuring a resistance of the transfer sheet by using pinch conveyance rollers which send the transfer sheet to the register roller and feed a current through the thickness of the transfer sheet, wherein the measuring apparatus measures the resistance by feeding a current to the transfer sheet when the leading edge of the transfer sheet arrives at the register roller by the pinch conveyance rollers and then the sheet stops, and transfer conditions of the transfer charger are determined according to the information measured by the measuring apparatus.

That is, in the image forming apparatus of the present invention, the following operations are carried out. A transfer sheet resistance measuring apparatus, in which the pinch conveyance rollers for sending the transfer sheet to the register roller are used as an electrode for feeding a current in the direction of thickness of the transfer sheet, feeds a current to the transfer sheet so as to measure the resistance of the transfer sheet when the pinch conveyance rollers send the leading edge of the transfer sheet to the register roller and then, the transfer sheet stops. Then, transfer conditions, that is, charging conditions of the transfer charger are determined according to the measured information. Accordingly, stable and high transfer efficiency can be obtained, and only one measuring apparatus is enough to measure the resistance of the transfer sheet even when a plurality of transfer sheet feeding means are provided in the apparatus.

Here, when a correction value of the difference between an electrical current value fed to the transfer sheet and an electrical current value passed through pinch conveyance rollers before the transfer sheet has not been sent by the pinch conveyance rollers, that is, when the transfer sheet has not been pinched between the pinch conveyance rollers, is used as the measured information of the resistance of the transfer sheet, of course, the influence due to deterioration with time of the pinch conveyance rollers or the amplifier is removed, resulting in higher measuring accuracy.

DETAILED DESCRIPTION OF THE PREFERRED EMBODIMENTS

Figure 1:
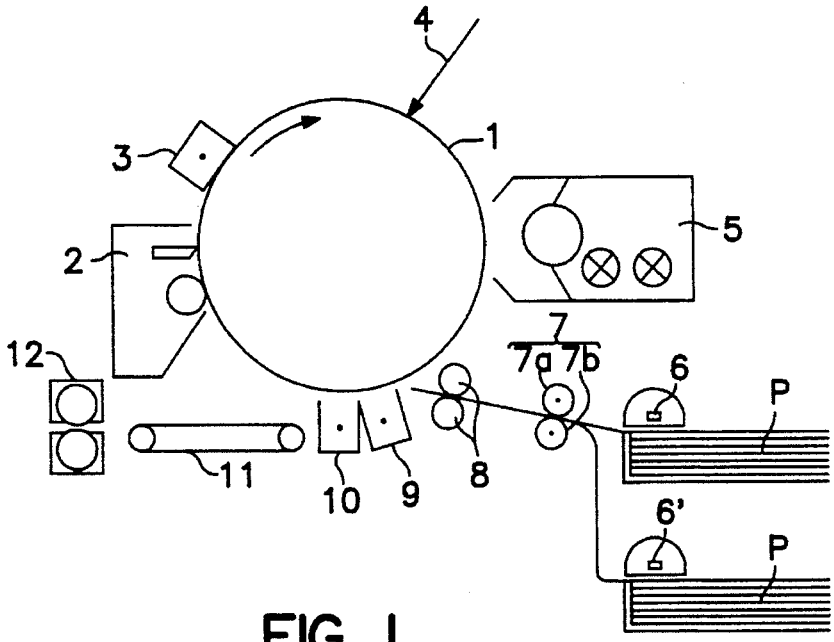
FIG. 1 is a view showing an outline structure of an example of an image forming apparatus of the present invention.

Referring to the drawings, the present invention will be described below.

Figure 2:
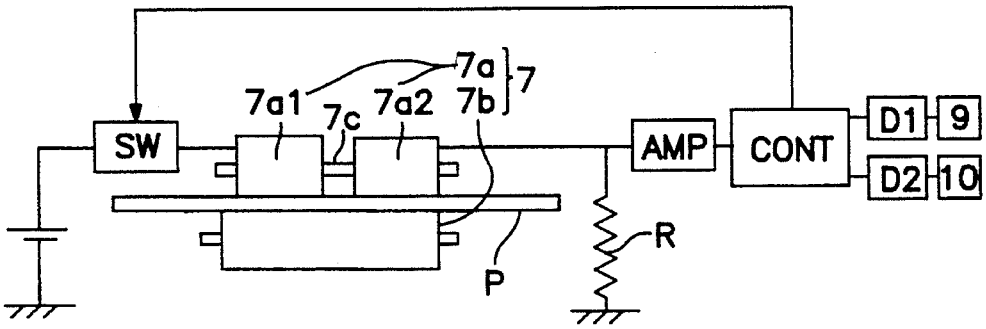
FIG. 2 is a circuit diagram for determining charging conditions of a transfer charger according to measured information of the resistance of a transfer sheet.
Figure 3:
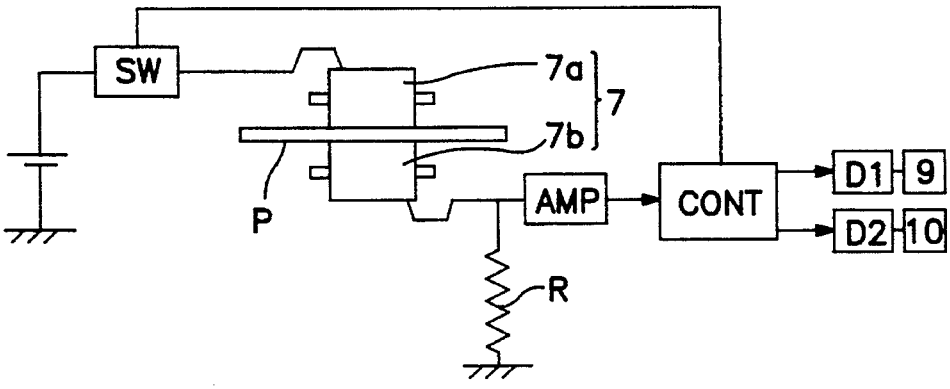
FIG. 3 is a circuit diagram for determining charging conditions of the transfer charger according to measured information of the resistance of the transfer sheet.
Figure 4:
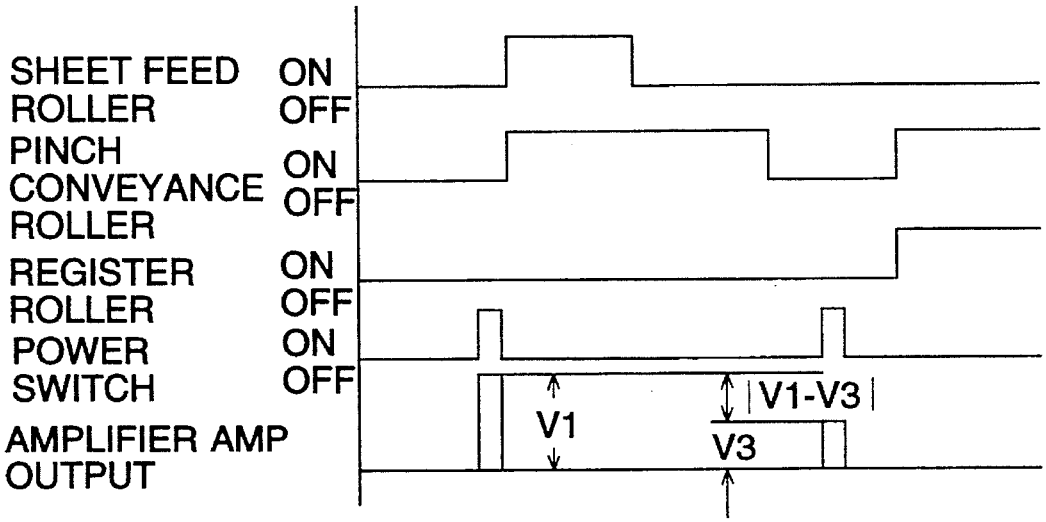
FIG. 4 is a timing chart of the control operation according to the present invention by a control apparatus.

FIG. 1 is a view showing an outline structure of an example of an image forming apparatus of the present invention. FIG. 2 and FIG. 3 are circuit diagrams for determining charging conditions of a transfer charger according to measured information of the resistance of a transfer sheet. FIG. 4 is a timing chart of the control according to the present invention by a control apparatus.

Figure 5:
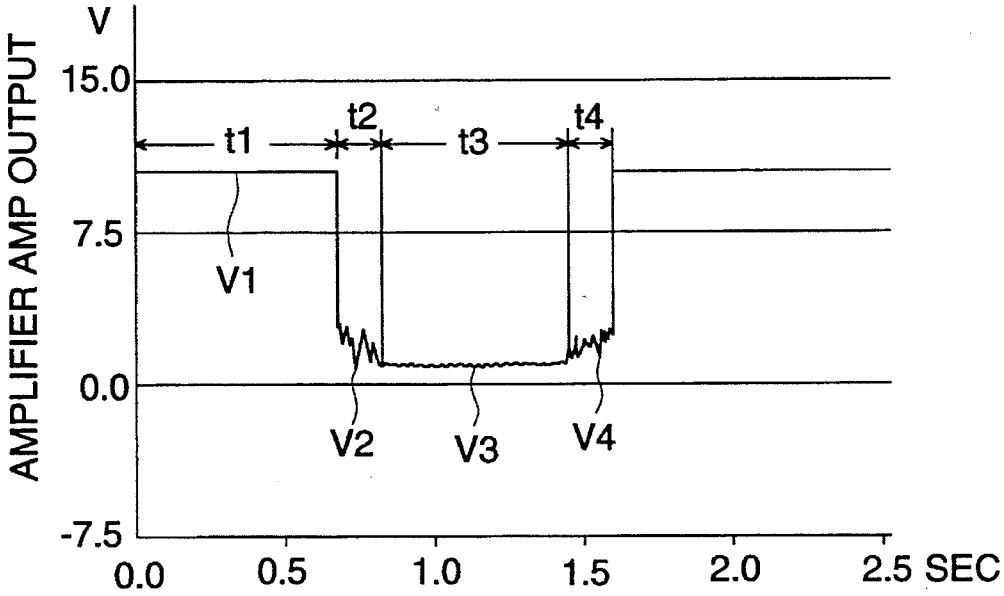
FIG. 5 is a graph showing the relationship between conditions of an electrode roller and an amplifier output.

FIG. 5 is a graph showing the relationship between conditions of an electrode roller and an amplifier output.

In FIG. 1, numeral 1 is an image forming body rotating in the arrowed direction. Numeral 2 is a cleaning unit for removing residual toners on the surface of the image forming body. Numeral 3 is a charger for charging the surface of the cleaned image forming body. Numeral 4 is an image exposure light projected onto the uniformly charged surface of the image forming body from a laser beam scanner or a document scanning exposure apparatus. Numeral 5 is a developing unit for developing the latent image formed by the image exposure 4 into a toner image. Numeral 6 is a sheet feed roller for feeding the uppermost transfer sheet P from a stack of transfer sheets P. Numeral 7 are pinch conveyance rollers for sending the transfer sheet P fed by the sheet feed roller 6. Numeral 8 is a register roller.

Pinch conveyance rollers 7 comprise conductive electrode rollers *7a* and *7b* for feeding a current in the direction of the thickness of the transfer sheet P as shown in FIGS. 2 and 3. The pinch conveyance rollers 7 temporarily stop when the leading edge of the transfer sheet P comes into contact with the register roller 8, and the transfer sheet P is curved between the pinch conveyance rollers 7 and the register roller 8. After that, the pinch conveyance rollers 7, together with the register roller 8, send the transfer sheet P to a transfer area at which a transfer charger 9 is opposite to the image forming body 1 so that the transfer sheet P is synchronized with the toner image.

Numeral 10 is a separation charger for separating the transfer sheet P, which has passed through the transfer area and onto which the toner image has been transferred, from the surface of the image forming body 1. Numeral 11 is a conveyer for conveying the separated transfer sheet P to a fixing unit 12. The transfer sheet P, onto which the toner image has been fixed by the fixing unit 12, is delivered outside the apparatus.

One electrode roller *7a* of the pinch conveyance rollers 7 shown in FIG. 2 is structured by the first and second electrode rollers ***7a*1 and *7a*2, both having conductive metal surface layers, which are connected with an insulated connecting shaft *7c*. The other electrode roller *7b* has a conductive elastic surface layer made of conductive rubber, etc., wherein the surface layer has enough length to pinch the transfer sheet between the electrode roller *7b* and the first and second electrode rollers *7a*1 and *7a*2, and to convey the transfer sheet. One electrode roller *7a* of the pinch conveyance rollers 7 shown in FIG. 3 has a metallic surface layer, and the other electrode roller *7b* has the conductive elastic surface layer made of conductive rubber, etc. The transfer sheet is pinched between the electrode rollers *7a* and *7b***, and conveyed.

While the leading edge of the transfer sheet P is stopped by the register roller 8, and the transfer sheet is conveyed so that the transfer sheet P is curved between the pinch conveyance rollers 7 and the register roller 8 and temporarily stopped, a control unit CONT for controlling the overall image forming apparatus turns on a power switch SW of the resistance measuring circuit for a short predetermined period of time. At this time, the pinch conveyance rollers 7 feed a current in the direction of the thickness of the pinched transfer sheet P. This current signal is converted into a voltage signal by the resistance R, and inputted into the control unit CONT through the amplifier AMP. According to the input signal, the control unit CONT drives the transfer charger 9 and the separation charger 10 through driving circuits D1 and D2 of the transfer charger 9 and the separation charger 10 on the charging conditions in which the maximum transfer efficiency and the separation reliability can be obtained with respect to the resistance of the transfer sheet. Thereby, even when the resistance of the transfer sheet changes, the toner image can be transferred onto the transfer sheet P with stable and high transfer efficiency, and the transfer sheet P, onto which the toner image has been transferred, can be stably separated from the image forming body 1.

In the pinch conveyance rollers 7 shown in FIG. 2, current is fed twice in alternating directions (***7a*1→*7b*→*7a*2), and in the pinch conveyance rollers 7 shown in FIG. 3, the current is fed only once (*7a*→*7b*). Since an electric voltage is applied in the direction of the thickness of the transfer sheet, the resistance can be measured with a relatively low voltage. Further, before the transfer sheet P is pinched and conveyed by the pinch conveyance rollers 7, the control unit CONT may feed a current between electrode rollers *7a* and *7b*, and may drive the transfer charger 9 and the separation charger 10 according to a signal of the difference between the signal due to the above-described current and the signal obtained when the transfer signal is pinched between the electrode rollers *7a* and *7b* as shown in FIG. 4. Due to this operation, the variations of the measured value due to deterioration with time of the pinch conveyance rollers 7** or the amplifier AMP are removed, and the resistance of the transfer sheet can be obtained more accurately, resulting in more stable enhancement of the transfer efficiency and the separation efficiency.

Incidentally, in this embodiment, the measurement for the resistance is conducted when the conveyance rollers stop.

The timing chart shown in FIG. 4 shows the above-described control by the control unit CONT and the output from the amplifier AMP to the control unit CONT. A period of t1 shown in FIG. 5 showing the relationship between conditions of the pinch conveyance roller and the amplifier output while the power switch is on, shows that the transfer sheet P is not pinched between pinch conveyance rollers 7 of the electrode rollers and the rollers 7 stop. Accordingly, the output V1 during the period shows the above-described reference value. T2 and t4 respectively show conditions that the pinch conveyance rollers 7 convey the transfer sheet P. Accordingly, outputs V2 and V4 during the periods correspond to the resistance of the transfer sheet obtained by the transfer sheet resistance measuring method disclosed in Japanese Patent Publication Open to Public Inspection 34834/1979. T3 shows conditions that the pinch conveyance rollers 7 pinch the transfer sheet and stop. Accordingly, output V3 during the period shows the measured value of the resistance of the transfer sheet P. Further, |V1–V3| shows a correction value of the resistance of the transfer sheet P in which the influence due to deterioration with time of the pinch conveyance rollers 7 or the amplifier AMP is removed.

The image forming apparatus of the present invention is not limited to the above-described examples, but a light emitting amount of a pre-transfer discharging lamp may also be determined according to the resistance of the transfer sheet P when the pre-transfer discharging lamp is provided between the developing unit 5 and the transfer charger 9. Further, when a transfer sheet guide provided between the sheet feed roller 6 and transfer charger 9 is grounded through a resistor, the resistor may also be switched according to the resistance of the transfer sheet.

In the image forming apparatus of the present invention, the resistance of the transfer sheet can be stably measured with high accuracy, and charging conditions of the transfer charger and the separation charger are determined according to the measured information. Accordingly, higher transfer efficiency and higher separation reliability can be stably obtained, and only one resistance measuring apparatus for the transfer sheet is enough even when a plurality of sheet feeding means are provided in the apparatus.

What is claimed is:

1. An image forming apparatus, comprising:

processing means for working on a recording member to form an image on the recording member;

wherein the processing means comprises an image carrying member on which a toner image is formed and transferring means for transferring the toner image onto the recording member, a stacking member on which the recording member is stored;

conveying means for conveying the recording member from the stacking member to the processing means along a conveyance passage, registering means for making the recording member to temporarily halt before the recording member is conveyed to the processing means so that the image formation on the recording member is in synchronization with the working of the processing means;

measuring means for measuring a value corresponding to an electrical resistance of the recording member, wherein said measuring means has a pair of rollers in said conveyance passage to convey the recording member when the recording member is nipped therebetween, and is adapted to measure a first value corresponding to the resistance when the pair of rollers nip the recording member therebetween and a second value corresponding to the resistance when the pair of rollers do not nip the recording member therebetween, to obtain the resistance of the recording member on the basis of the first value and the second value;

control means for determining the process conditions to form the image on the recording member on the basis of the resistance of the recording member and for controlling the processing means in accordance with the determined process conditions.

2. The apparatus of claim 1, wherein said measuring means measures the resistance of the recording member on the basis of the difference between the first value and the second value.

3. The apparatus of claim 1, wherein the control means determines a transferring condition of the transferring means.

4. The apparatus of claim 3, wherein the transferring condition is a charge condition.

5. The apparatus of claim 1, wherein the processing means further comprises separating means to separate the recording member from the image carrying member.

6. The apparatus of claim 5, wherein the control means determines a separating condition of the separating means.

7. The apparatus of claim 1, wherein the stacking member comprises plural stackers, a common passage is provided for the stackers, and the measuring means is disposed on the common passage.

8. The apparatus of claim 1, wherein the measuring means comes in contact with the recording member so as to nip the recording member and the measuring means comprises means for applying a current in a direction of the thickness of the recording member.

9. The apparatus of claim 1, wherein the measuring means measure the value when the conveying means is stopped.

* * * * *